US007975808B2

(12) United States Patent
Smith et al.

(10) Patent No.: US 7,975,808 B2
(45) Date of Patent: Jul. 12, 2011

(54) SATURATION CONTROL FOR DESTINATION DISPATCH SYSTEMS

(75) Inventors: Rory Smith, El Cajon, CA (US); Richard Peters, Great Kingshill (GB)

(73) Assignee: Thyssenkrupp Elevator Capital Corp., Troy, MI (US)

( * ) Notice: Subject to any disclaimer, the term of this patent is extended or adjusted under 35 U.S.C. 154(b) by 484 days.

(21) Appl. No.: 12/200,276

(22) Filed: Aug. 28, 2008

(65) Prior Publication Data

US 2009/0133968 A1 May 28, 2009

Related U.S. Application Data

(60) Provisional application No. 60/968,421, filed on Aug. 28, 2007.

(51) Int. Cl.
*B66B 1/18* (2006.01)

(52) U.S. Cl. ..... 187/382; 187/247

(58) Field of Classification Search ..... 187/247, 187/248, 380–388, 391–393; 706/910
See application file for complete search history.

(56) References Cited

U.S. PATENT DOCUMENTS 5,239,141 A * 8/1993 Tobita et al. ..... 187/382
5,283,399 A * 2/1994 Fujino et al. ..... 187/382
5,923,004 A * 7/1999 Whitehall et al. ..... 187/382
6,000,504 A * 12/1999 Koh et al. ..... 187/382
6,315,082 B2 * 11/2001 Hikita ..... 187/382
6,325,178 B2 * 12/2001 Hikita et al. ..... 187/382
6,439,349 B1 8/2002 Smith
6,619,436 B1 * 9/2003 Hikita ..... 187/382
7,568,556 B2 * 8/2009 Hikita ..... 187/382
2010/0230213 A1 * 9/2010 Kobori et al. ..... 187/387
2010/0270110 A1 * 10/2010 Mattsson et al. ..... 187/387

FOREIGN PATENT DOCUMENTS

EP 1 553 038 7/2005

OTHER PUBLICATIONS

Abstract for EP 1 553 038.

* cited by examiner

*Primary Examiner* — Jonathan Salata
(74) *Attorney, Agent, or Firm* — Frost Brown Todd LLC

(57) ABSTRACT

One version of this disclosure includes a system for assigning an elevator car to respond to a call signal wherein a controller is responsible for determining which elevator car will respond to a call signal. This version includes the controller receiving a hall call signal, receiving information regarding the elevator system, determining whether the call assignment can be made in view of a first rule associated with a banned call assignment, and eliminating the rule against banned call assignments when necessary to avoid saturation of the elevator system.

11 Claims, 3 Drawing Sheets

SATURATION CONTROL FOR DESTINATION DISPATCH SYSTEMS

PRIORITY

The application claims priority from the disclosure of U.S. Provisional Patent Application Ser. No. 60/968,421, entitled "Saturation Control For Destination Dispatch Systems," filed Aug. 28, 2007, which is herein incorporated by reference in its entirety.

FIELD OF THE INVENTION

The present disclosure relates in general to elevator systems and, in particular, to maximizing the handling capacity of elevator systems through saturation control.

BACKGROUND

Existing hall call allocation systems and methods use criteria, such as waiting time, time to destination, energy consumption, and elevator usage, with neural networks, generic algorithms, and/or fuzzy logic to find an optimum solution for assigning a new hall call to one of a group of available elevator cars. These existing systems and methods generally fall into one of two categories; Estimate Time of Arrival ("ETA") based systems and destination dispatch based systems.

Conventional ETA based elevator systems use up and down buttons in the hallway to call the elevators. When a person wishes to call an elevator to a floor either the up or down button is pressed. The selected button is then illuminated indicating that the call has been accepted. While the call is often immediately assigned to a car, it does not need to be immediately assigned. In fact, calls are often reassigned to different cars due to changes in the traffic situation.

With destination dispatching systems the user enters his destination on a keypad or touch screen located in the hallway. Immediately a display indicates which elevator has been selected and directs the individual to proceed to that elevator and wait for the car to arrive. Reassignments or delayed assignments in such systems are not possible. Although destination dispatch systems can handle up to 50% more traffic than conventional systems, the necessity to immediately assign calls can create inefficiencies in the system.

For three or four decades elevator systems have used load weighing systems to avoid unnecessary stops. If an elevator is fully loaded, then it can not accept additional passengers. A system known in the industry as "load weighing bypass" would not permit elevators traveling down that were fully loaded to accept additional call assignments if the cars were fully loaded. This was extremely beneficial because a full elevator that makes a stop at a floor to pickup passengers that cannot enter the elevator is a false stop that degrades performance by wasting time.

Requiring calls to be assigned immediately in destination dispatching systems often means that optimal dispatching solution cannot always be utilized. When destination dispatch systems were introduced this system was used by most practitioners to assure that a person was not assigned to a car that was full regardless of car travel direction. While this was a logical decision, it could create problems if the traffic level was so intense that a dispatching solution could not be found. One must recall that destination dispatch systems must make immediate call assignments and that certain assignments are banned. In this case systems would either send a message to an I/O device that indicated that no assignment was possible such as "XX" or a textual message would be displayed such as "Unable to assign your call." Try again later.

Both of these answers make the situation worse because passengers will repeatedly reenter their destination further overloading the system. Some high profile destination dispatch systems go into saturation daily thereby forcing people to use the stairs during peak periods.

Another example of a commonly banned assignment is associated with the direction of travel for elevator cars. For example, if a waiting passenger located on the tenth floor wants to travel to the lobby the best solution might be for an elevator traveling up to the $11^{th}$ floor to pick up the waiting passenger on the way. The $10^{th}$ floor passenger would be required to up travel to the $11^{th}$ floor before traveling to the lobby. While this type of journey is very efficient, it is a banned assignment in virtually all destination dispatching systems.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

DETAILED DESCRIPTION

Figure 1:
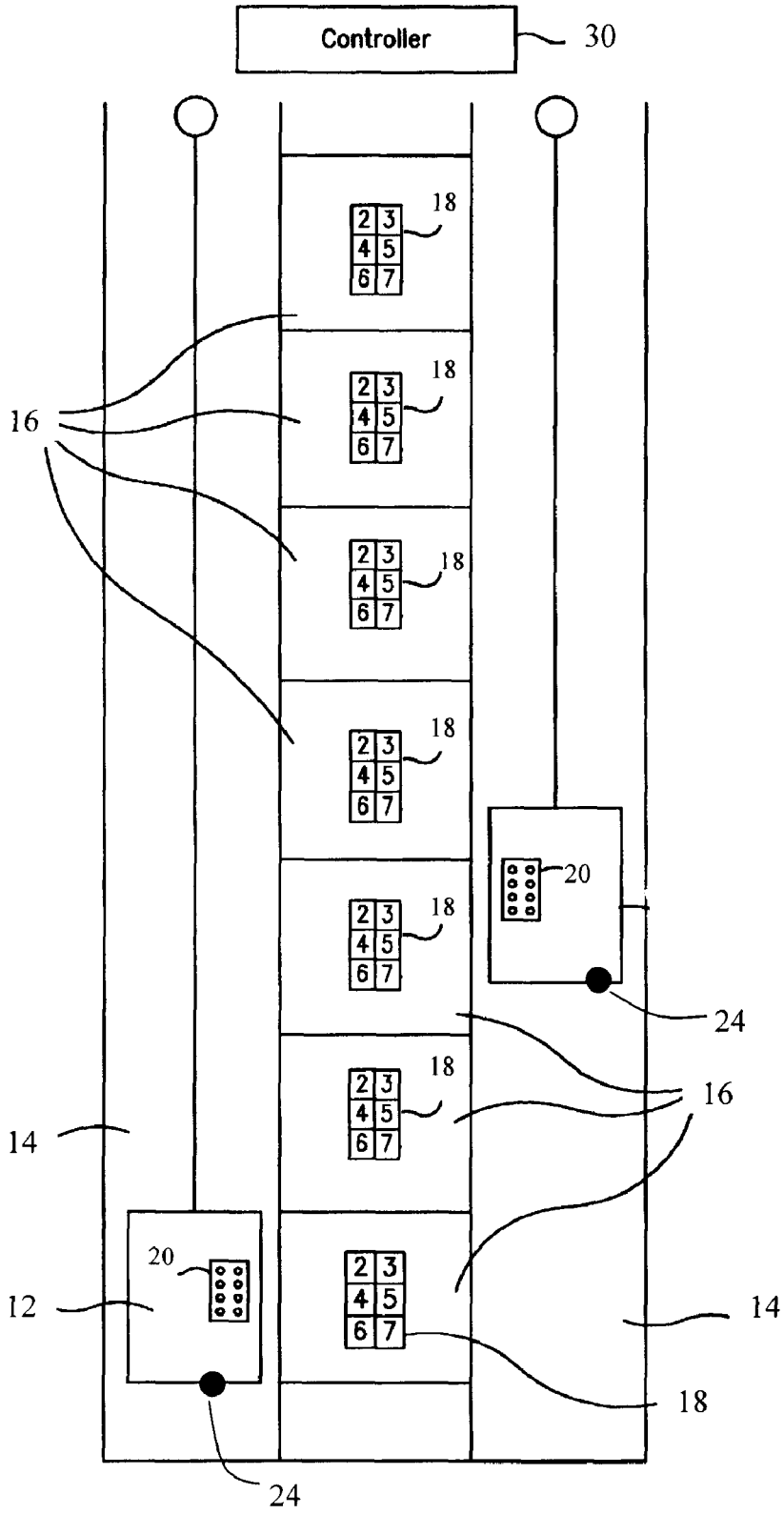
FIG. 1 shows a perspective view of one version of an elevator system.

The following description of certain examples of the current application should not be used to limit the scope of the present invention as expressed in the appended claims. Other examples, features, aspects, embodiments, and advantages of the invention will become apparent to those skilled in the art from the following description. Accordingly, the figures and description should be regarded as illustrative in nature and not restrictive.

Elevator passengers generally prefer to have a substantial amount of personal space between themselves and other people. To account for passenger comfort, in most elevator systems and elevator is considered "fully loaded" when it is only filled to 60% of its capacity. It is possible to fill an elevator to 80% or 90% of its rated capacity if passengers are willing to give and additional portion of this personal space.

Versions described herein provide a destination dispatching algorithm that uses load weighing to estimate the amount of available space in an elevator car for picking up additional passengers. If an elevator car is considered "fully loaded" by normal standards, such as when the elevator car is at or above 60% of capacity, the elevator car will bypass a stop so long as there are other acceptable dispatching solutions available to service the hall call. However, if no solution can be found, then the elevator cars will be pre-programmed to assume an infinite capacity. The resulting effect is that an elevator that would have bypassed a floor because it was over capacity will now be assigned to that hall call.

Assigning the "fully loaded" elevator to the hall call, where the elevator may only be at 60% of capacity, creates two potentially positive results. First, the passenger may choose to enter the "fully loaded" elevator if they are willing to give up a bit more of their personal space. This will improve the overall efficiency of the system by making more hall calls available during peak times and will help prevent the system from going into saturation.

Second, upon viewing a technically "fully loaded" elevator a passenger may choose to wait for the next available car. Although the passenger is still waiting, they have been given the option of entering the elevator and they are less likely to become impatient in waiting for a second car as they have made the decision to wait. This will also prevent a waiting passenger from repeatedly entering in their destination information in response to a "try again later" response from the elevator system.

Giving passengers the option to enter a "fully loaded" elevator during peak times may improve the efficiency of the system, may improve a passenger's perception of their wait, and may help prevent the elevator system avoid saturation where the controller indicates to waiting passengers that no solutions are currently available. It should be noted that passenger safety is not compromised because if the load weighing system detects that the elevator is overloaded the elevator will not leave the floor until sufficient passengers exit the elevator so that it is not overloaded.

More specifically, one example of a destination dispatch control system that may be used in accordance with versions herein is described in U.S. Pat. No. 6,439,349, which is incorporated by reference in its entirety. The control system may include an optimization algorithm that selects the elevator that can answer a new hall with the lowest cost on the system. This total cost is determined as the sum of estimated time to destination (ETD) and system degradation factors (SDF).

ETD is the estimated time to destination and refers to the time it will take an elevator to travel to the floor where a passenger is waiting and the time it will take to then take the passenger to his destination considering all prior assignments the particular elevator has. SDF refers to the cost the answering of a call has on the passengers already in the system. For example, if an elevator is traveling from floor 1 to floor 20 with 10 passengers aboard, it could pick up a passenger on floor 12 and take him to floor 13. However, answering this call would delay the people already traveling in the car by approximately 10 seconds to pick up the passenger and by an additional 10 seconds to drop off the passenger. Thus, each passenger would experience an additional 20 second delay making the SDF for the elevator car (all 10 passengers) 200 seconds.

As described, existing systems would be available to respond to a hall call only if their capacity was below a particular threshold such as, for example, 60%. If the elevator car with the lowest call cost was full then the allocation would be banned and another car would be selected. If all of the cars are "fully loaded" based upon the pre-determined threshold than the elevator system will enter saturation and the waiting passenger will be asked to re-request an elevator at a later time or will be told that no solutions are available.

Referring now to the drawings in detail, wherein like numerals indicate the same elements throughout the views, FIG. 1 depicts one version of an elevator system (10). The elevator system (10) includes multiple elevator cars (12) positioned within a plurality of elevator shafts (14). The elevator cars (12) travel vertically within the respective shafts (14) and stop at a plurality of landings (16). As depicted in the example, each of the various landings (16) includes an external destination entry device (18). The elevator cars (12) include internal destination entry devices (20). Examples of destination entry devices include interactive displays, computer touch screens, or any combination thereof. Still, other structures, components, and techniques for destination entry devices are well known and may be used. Yet further, traditional up/down call signals may be used at a landing.

As shown in the example of FIG. 1, an elevator (10) is shown that is governed by a controller (30). It will be appreciated that versions of the controller (30) and the elevator (10) are described by way of example only and that various suitable systems, techniques, and components may be used to govern the movement of the elevator cars (12). In one version, the controller (30) is a computer-based control system configured to assign new hall calls to one of a plurality of elevator cars.

Figure 2:
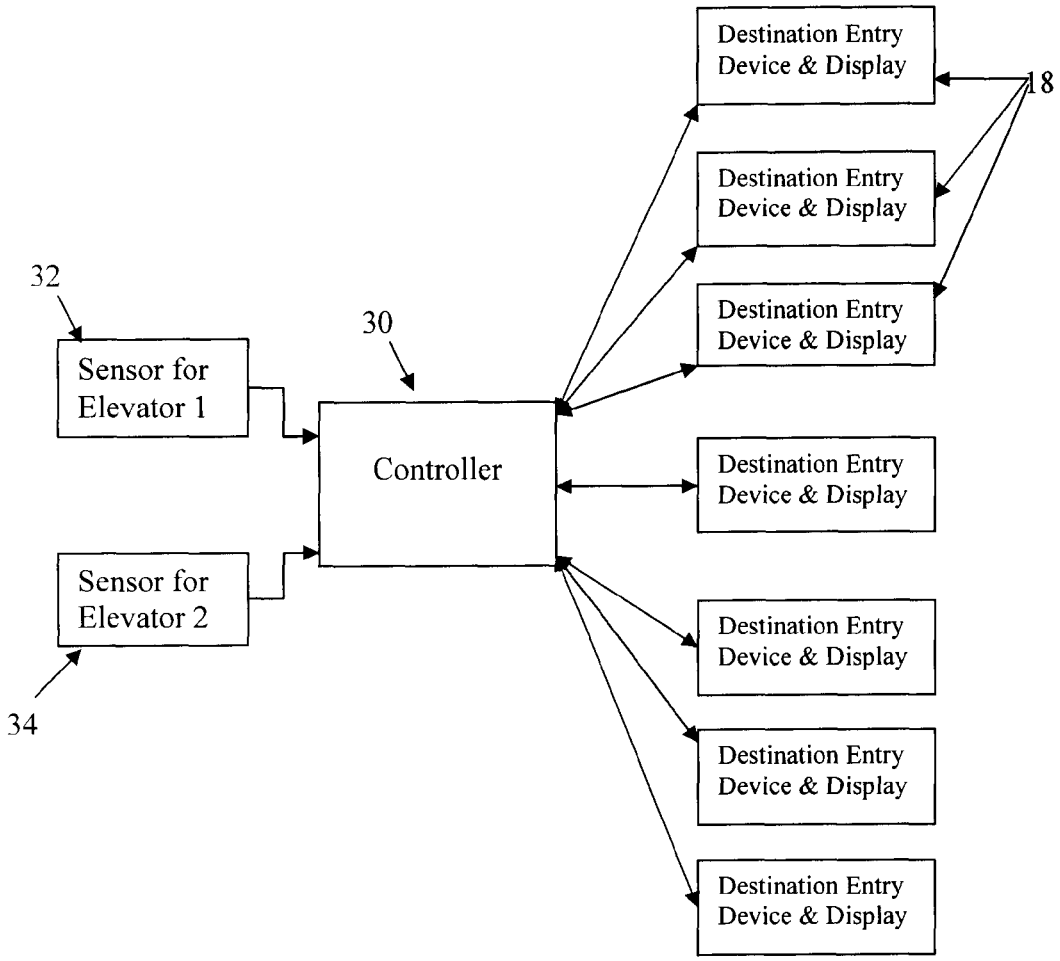
FIG. 2 shows a schematic depicting one version of a controller system governing the operation of the elevator system of FIG. 1.

As shown in FIG. 2, the controller (30) may receive a plurality of suitable inputs from a first sensor (32) from a first elevator and a second sensor (34) from a second elevator to aid in governing the assignment of hall calls. The controller (30) is configured to receive inputs from a plurality of destination entry devices (18) to aid in governing the movement of the elevator cars (12). Examples of such inputs received by the controller (30) may include, but are not limited to, new destination calls from passengers, the status of each elevator, the current time, an average speed for an elevator, elevator load sensor information, elevator acceleration, and a designated handling capacity value. Values may be preprogrammed, measured, or include combinations thereof. For example, average elevator speed may be pre-programmed and elevator weight may be measured by a load sensor during operation. It will be appreciated that any suitable configuration of the controller (30) with various entry devices (18) is contemplated.

The controller (30) may also include pre-programmed data-handling information and algorithms to facilitate management of the data received. For example, the controller (30) may receive information from a load cell indicating the overall passenger weight of an elevator car. The controller (30) may be pre-programmed to estimate the number of individuals within an elevator car based upon total weight and/or the approximate available capacity. The controller (30) may also be pre-programmed with threshold amounts for determining when an elevator car (12) is "fully loaded" such as, for example, when an elevator is at 60% of capacity. The controller (30) may also contain pre-programming associated with ETD, SDF, elevator handling capacity (HC), such as a coefficient associated with current traffic patterns, and/or any other suitable factors.

Figure 3:
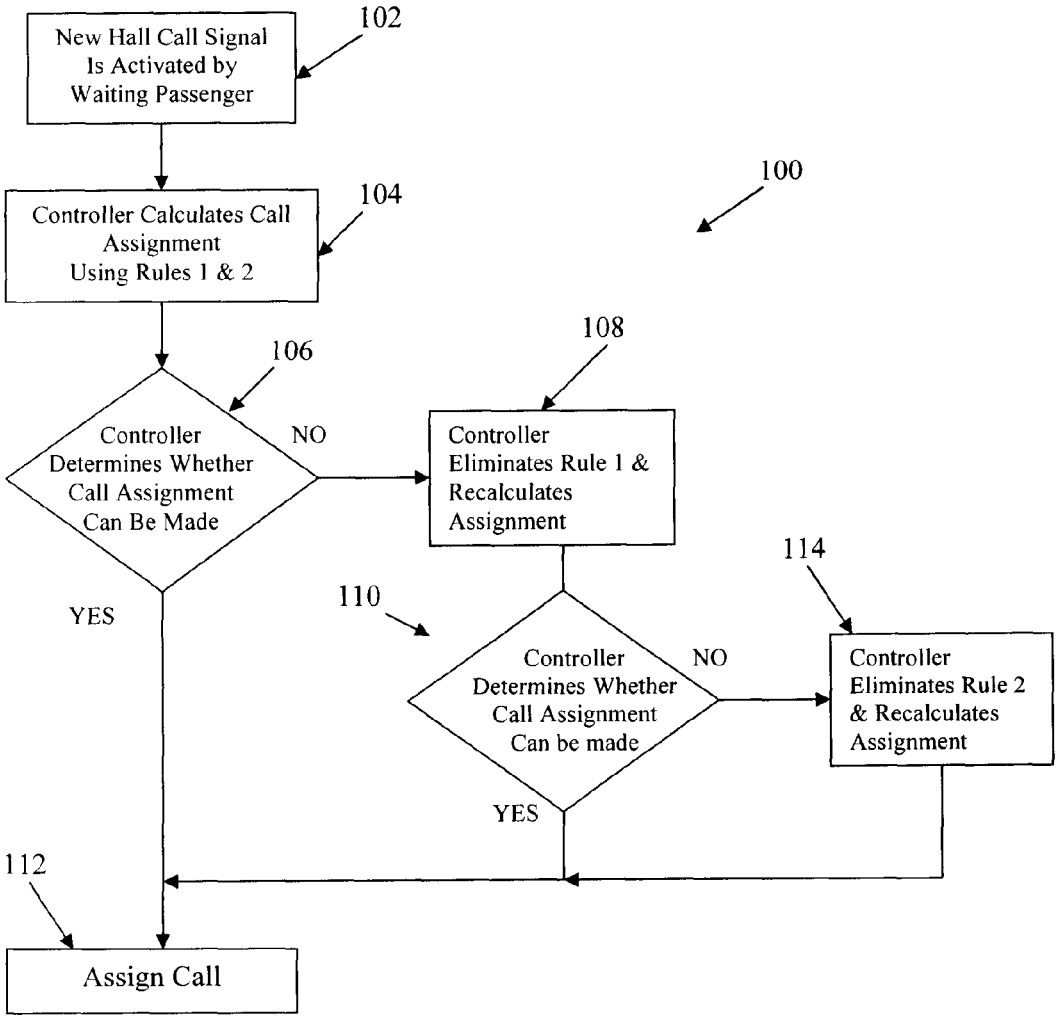
FIG. 3 shows a flowchart depicting one version of a method for assigning a new call.

FIG. 3 illustrates one version of a flow chart illustrating a method (100) of operation of an elevator system in assigning hall calls. The method (100) comprises Step (102), which comprises activating a new hall call signal. Step (102) comprises initiating a hall call in a destination dispatch system for an elevator car (12) from an external destination entry device (18). Once the hall call has been initiated the request is transmitted to the controller (30).

Step (104) comprises calculating a call assignment for the call request. One version of the calculation comprises evaluating whether a call request can be honored in view of at least one pre-programmed rule. In the illustrated method (100), the calculation is based upon a first rule and a second rule. The first rule is, "If the optimal assignment required a passenger to first travel in the direction opposite to that of his destination, then select another car." The second rule is, "If car is full do not assign additional passengers."

Step (106) comprises determining whether a call assignment can be made based upon the answers to the first rule and the second rule of Step (104). If the answer is "Yes", where an elevator car is available that does not need to take a current passenger in the opposite direction they are currently traveling in and the elevator is not currently "fully loaded" based upon a pre-determined threshold then the method (100) will proceed to Step (112).

Step (112) comprises assigning an elevator car (12) to the hall call of Step (102). If the answer to Step (106) is "Yes", Step (112) comprises controller (30) using any suitable algorithm to assign an available elevator car (12) to the hall call. For example, Step (112) may comprises selecting from all available cars the elevator car (12) having the lowest ETD for the hall call request. Other suitable factors such as handling capacity, estimated waiting time, estimated travel time, elevator traffic, and time of day may be factored into the assignment decision.

If the response to Step (106) is "No", where all of the elevator cars (12) in the elevator system are overloaded or are moving in a direction opposite to the hall call request then the method (100) proceeds to Step (108).

Step (108) comprises eliminating the first rule to determine whether an assignment can then be made. In the illustrated example, eliminating the first rule would not prohibit an elevator car (12) from responding to a hall call that is moving in the opposite direction of the hall call request. For example, if a waiting passenger located on the tenth floor wants to travel to the lobby the most efficient solution might be for an elevator traveling up to the $11^{th}$ floor to pick up the waiting passenger on the way. The $10^{th}$ floor passenger would be required to up travel to the $11^{th}$ floor before traveling to the lobby. While this type of journey is very efficient, it is generally a banned assignment. Step (108) comprises allowing the first rule to be broken, where if elevators are not otherwise available an elevator car (12) will be allowed to travel in the opposite direction of a hall call request to pick up a passenger. In this manner, a traditionally banned assignment will be allowed only under circumstances where a waiting passenger has no other elevator car options. Allowing such traditionally banned assignments under limited circumstances may improve the efficiency of the overall system and help prevent saturation.

Step (110) comprises the controller (30) determining whether a call assignment can now be made with the first rule having been eliminated. If the answer is "Yes" and the controller can now assign an elevator car (12) to the hall call request the method (100) will proceed to Step (112).

If the response to Step (110) is "No", where all of the elevator cars (12) in the elevator system are overloaded, then the method (100) proceeds to Step (114).

Step (114) comprises eliminating the second rule to determine whether an assignment can then be made. Step (114) comprises eliminating the rule that elevator cars (12) that are deemed "fully loaded" are banned from being assigned to new hall calls. Controller (30) will be pre-programmed to assume that all elevator cars (12) have an infinite capacity and the method will proceed to Step (112) for elevator car assignment. Although a waiting passenger may be assigned a "fully loaded" elevator, the passenger may still choose to board the elevator if they are willing to enter a more crowded space.

In this manner, passengers may be willing to crowd elevators and, thus, improve the efficiency of the elevator system during peak times. If the passenger does not choose to enter the elevator it less likely that the will become impatient as they have made a decision to wait for an additional elevator car. Additionally, in destination dispatch systems, assigning a full elevator car will prevent a passenger from repeatedly entering the destination information when told to "try again later" during a saturation condition.

It will be appreciated that the first rule and the second rule are described by way of example only and any suitable rule in any suitable order may be provided. For example, any hall call assignment that is banned during off-peak times may be allowed under peak traffic conditions in accordance with method (100). The significance of the first rule and the second rule may be reversed, only a single rule may be used, or a plurality of rules may be incorporated.

The versions presented in this disclosure are described by way of example only. Having shown and described various versions, further adaptations of the methods and systems described herein may be accomplished by appropriate modifications by one of ordinary skill in the art without departing from the scope of the invention defined by the claim below. Several of such potential modifications have been mentioned, and others will be apparent to those skilled in the art. For instance, the examples, embodiments, ratios, steps, and the like discussed above may be illustrative and not required. Accordingly, the scope of the present invention should be considered in terms of the following claims and is understood not to be limited to the details of structure and operation shown and described in the specification and drawings.

We claim:

1. A method for assigning a hall call to one of a plurality of elevator cars in an elevator system comprising the steps of:

(a) receiving a hall call signal, the hall call signal originating at an elevator landing;

(b) providing a first rule associated with a first call assignment type that is banned under normal operating conditions;

(c) determining with a controller whether a call assignment can be made in view of the first rule;

(d) assigning one of the plurality of elevator cars to the hall call if the call assignment can be made in view of the first rule; and (e) eliminating the first rule if the call assignment can not be made in view of the first rule, where the hall call is then assigned to one of the plurality of elevator cars.

2. The method of claim 1, wherein the first rule comprises banning the controller from making the call assignment to one of the plurality of elevator cars when the call assignment requires that the elevator car travel in a direction opposite to the direction requested by a passenger after the passenger has already boarded.

3. The method of claim 1, wherein the first rule comprises banning the controller from making the call assignment to one of the plurality of elevator cars when the elevator car is determined to be fully loaded.

4. The method of claim 3, wherein the elevator car is determined to be fully loaded by the controller when the elevator car is below full capacity.

5. The method of claim 1, wherein the elevator system is a destination dispatch elevator system.

6. The method of claim 1, further comprising the step of providing a second rule associated with a second call assignment type that is banned under normal operating conditions.

7. The method of claim 6, further comprising the step of eliminating the second rule if the call assignment can not be made in view of the second rule, where the hall call is then assigned to one of the plurality of elevator cars.

8. The method of claim 6, wherein the step of determining with a controller whether a call assignment can be made in view of the first rule further comprises determining with the controller whether the call assignment can be made in view of the second rule.

9. The method of claim 8, the step of assigning one of the plurality of elevator cars to the hall call if the call assignment can be made in view of the first rule comprises assigning one of the plurality of elevator cars to the hall call if the call assignment can be made in view of the first rule or the second rule.

10. The method of claim 1, wherein the elevator system is an ETA dispatch elevator system.

11. The method of claim 1, wherein the call assignment is made based upon estimated time to destination.

* * * * *